US005348420A

United States Patent [19]

Bernhardt

[11] Patent Number: 5,348,420

[45] Date of Patent: Sep. 20, 1994

[54] METHOD AND ARRANGEMENT FOR INFLUENCING LIQUID IN GROUND

[75] Inventor: Bruno Bernhardt, Reutlingen, Fed. Rep. of Germany

[73] Assignee: IEG Industrie-Engineering GmbH, Reutlingenll-Betzingen, Fed. Rep. of Germany

[21] Appl. No.: 996,658

[22] Filed: Dec. 24, 1992

[30] Foreign Application Priority Data

Dec. 24, 1991 [DE] Fed. Rep. of Germany ..... 4142917
Feb. 19, 1992 [DE] Fed. Rep. of Germany ..... 4204991

[51] Int. Cl.[5] ..... E03B 3/12

[52] U.S. Cl. ..... 405/52; 405/128; 166/306

[58] Field of Search ..... 405/36, 43, 52, 128–131; 166/306, 370; 210/170, 747

[56] References Cited

U.S. PATENT DOCUMENTS

| | | | |
|---|---|---|---|
| 3,111,983 | 11/1963 | Frank | 166/306 X |
| 4,766,957 | 8/1988 | McIntyre | 166/306 X |
| 4,805,697 | 2/1989 | Fouillout et al. | 166/306 X |
| 4,950,394 | 8/1990 | Bernhardt et al. | 210/170 |
| 5,080,172 | 1/1992 | Jones | 166/306 X |
| 5,116,163 | 5/1992 | Bernhardt | 210/170 X |
| 5,154,538 | 10/1992 | Bockle | 405/128 |
| 5,171,103 | 12/1992 | Bernhardt | 405/128 |

FOREIGN PATENT DOCUMENTS

| | | | |
|---|---|---|---|
| 552442 | 1/1958 | Canada | 166/306 |
| 270826 | 8/1989 | Fed. Rep. of Germany . | |
| 3842740 | 6/1990 | Fed. Rep. of Germany . | |
| 3931011 | 3/1991 | Fed. Rep. of Germany . | |
| 3931012 | 4/1991 | Fed. Rep. of Germany . | |

OTHER PUBLICATIONS

Hartmann, et al "Untersuchungen Zur Enteisenung Und Entmanganung Im Grundwasser-Leiter", Wasserwirtschaft-Wassertechnik 8 (1983), pp. 280–285.

U. Rott, "Anwendung Und Grundlagen Eines Neuen Verfahrens Zur Enteisenung Und Entmanganung Von Grundwasser Im Boden", bbr 26, Oct. 1975, No. 10, pp. 357–362.

*Primary Examiner*—Randolph A. Reese
*Assistant Examiner*—John Ricci
*Attorney, Agent, or Firm*—Michael J. Striker

[57] ABSTRACT

A method of influencing a liquid in ground by forming a liquid circulation in ground comprises a shaft arranged in ground and extending to a desired liquid region, a pump arranged in the shaft for producing a liquid circulation, the pump having a feeding power selected so that in a shaft surrounding a liquid peak located above a normal liquid level is produced.

25 Claims, 5 Drawing Sheets

Fig. 5
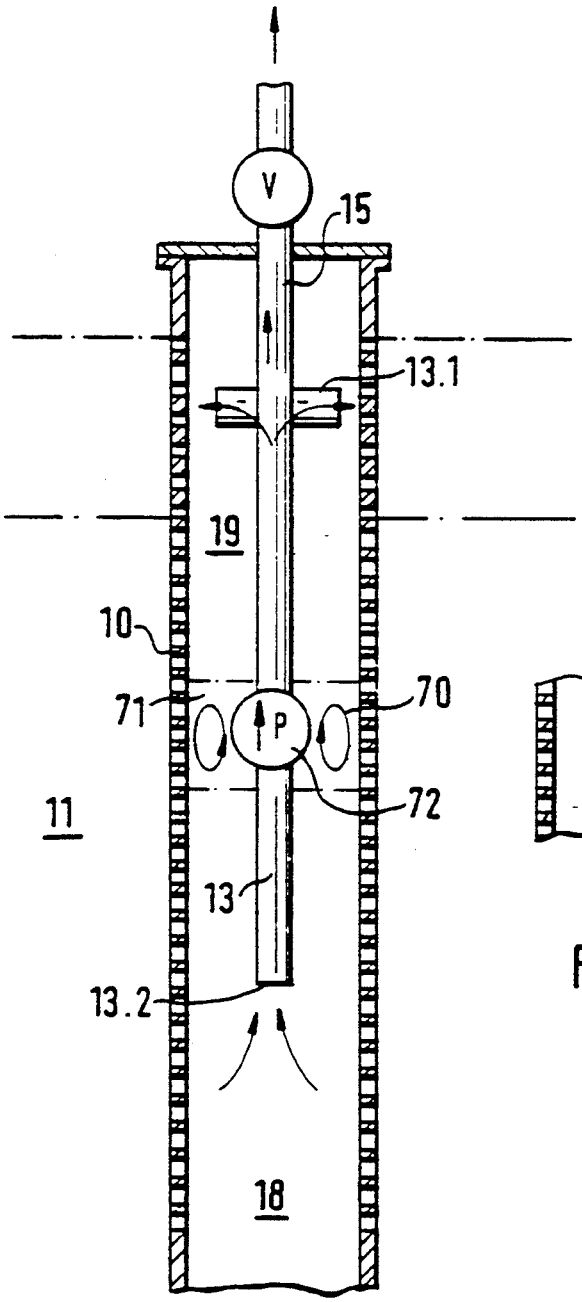
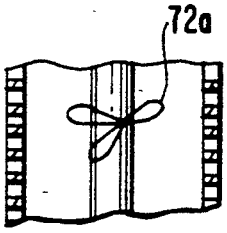
Fig 5a

METHOD AND ARRANGEMENT FOR INFLUENCING LIQUID IN GROUND

BACKGROUND OF THE INVENTION

The present invention relates to a method for influencing of liquid which is located in ground region by forming a liquid circulation in the ground.

In particular it relates to such a method in which the circulation is produced by a pump arranged in a shaft extending in the ground to a desired liquid region. It also relates to an arrangement for influencing the liquid in the ground.

Arrangements for cleaning contaminated ground water are known in the art. In a known arrangement a pump located in a shaft produces a fluid circulation through the ground and the liquid is supplied through a filter located in the shaft or in the permeable shaft wall regions to remove the impurities. In this method and the associated arrangement it is possible to filter out a greater part of impurities; however, a filter exchange inside the shaft must be taken into consideration. Moreover, the treatment processes for filtering out of impurities are limited. The known pumping of the liquid from a shaft to a cleaning device located outside of the shaft or to another treatment device has substantial disadvantages in that a lowering of the liquid level in the shaft region occurs and therefore the vegetation and the structural foundation in the lowering region are endangered. Therefore, simple pumping of of the fluid from the ground in planted and/or cultivated areas have been avoided.

SUMMARY OF THE INVENTION

Accordingly, it is an object of the present invention to provide a method of and an arrangement for allside influencing of liquid located in ground which provides for an intensive accumulation of liquid with raising of the liquid level.

In keeping with these objects and with others which will become apparent hereinafter, one feature of the present invention resides, briefly stated, in a method of influencing fluid in the ground, in which a corresponding feeding power of the pump in the shaft environment provides for a liquid peak located above the normal liquid level.

Calculations and research of cleaning arrangements have shown that with the method of a partial flow removal any liquid lowering in the shaft region can be avoided, and the liquid partial flow can be subjected to any desired treatment. Thus, with the pump located in the shaft the fitting power can be provided to reach the maximum power depending on the liquid flow conditions in the surrounding ground, and also high feeding pressure can be obtained for obtaining a maximum liquid circulation in the ground. The liquid which is not removed in the upper shaft region can be again supplied into the ground, where a very broad horizontal outflow region can be produced. This is favorable since a liquid tight horizontal wall is arranged at least approximately at the height of the liquid level in the ground. An optimal circulation is better achieved when a partial flow is supplied under pressure back into the ground and to a matching location in the circulation region. A level height of the outflow can be selected in dependence on the ground properties or in view of a desired flushing in the predetermined ground layers. It has been shown that a return supply of the withdrawn partial stream can be dispensed with and at the same time one does not have to fear a lowering of the liquid level in the immediate surrounding of the shaft region since in the forced liquid circulation sufficient ground water is pulled.

The ground water can be aspirated in the upper shaft region and then supplied back in the lower shaft region into the ground. Thereby the produced liquid circulation increases the ground water level in the surrounding of the shaft and a great accumulation of liquid is obtained.

The method in accordance with the present invention is not limited to the cleaning of ground water from impurities. During the adjustment of a liquid circulation intensity it is not necessary in all cases to maintain a laminar liquid flow in the ground. The method can be used for example for a chemical or biological treatment of the ground, or for the utilization of the ground as storage space for excessive rain water, or for example hot liquids such as hot cooling water which is to be held in circulation also with alternating volumes when needed withdrawn in a partial stream for heating. In this case not only the liquid located in or brought into the ground is influenced, but also the ground itself is influenced for example warmed up with the storage action.

The method in accordance with the present invention facilitates the frequently problematic cleaning of the filter from deposits which affect substantially the operational life of the cleaning device. By the forced circulation a strong rinsing through the filter and the filter filling is performed. Due to a short-time increase of the pump power and/or a reverse of the feeding direction the deposits can be loosened also in a filter filling which surrounds the shaft pipe.

An arrangement for performing the method in accordance with the present invention has a plurality of permeable wall portions located at a distance from one another in a longitudinal direction of the shaft and at least one transverse wall with an opening for a thoroughgoing passage, wherein a partial flow supply conduit which lead to treating device opens in a shaft region between two transverse walls. For return supply of the liquid partial stream, in the inventive arrangement at least one partially permeable return pipe or at least one partially permeable return shaft is provided. The liquid which circulates in the ground can be brought through the return pipe or the return shaft.

The experience has shown that liquid circulation in the ground is hindered by gas phases occurring in it. In order to eliminate such an obstacle, the shaft region can be limited by a pipe with impermeable and permeable wall portions and transverse walls, and the space between the pipe and the shaft wall can be filled with impermeable blocking layers and partially with a permeable gravel filling. At least the gravel filling before the permeable pipe wall portion provided for a liquid discharge is aerated outwardly through an upper blocking layer. The removal of the undesired gas phases from the liquid circulation paths can be improved when the permeable gravel filling is under negative pressure. The negative pressure additionally contributes to the discharge of the liquid from the shaft. It is to be understood that a pressure difference must be taken into consideration for devices in which a liquid cleaning is performed in accordance with the negative pressure evaporation process. In such a case the shaft region above the liquid level is placed under negative pressure and provided with a known nozzle body to distribute a supplied gas in the the throughflowing liquid in order to drive out volatile impurities from the liquid.

Depending on the purpose or use of the device, dosing conduits for treatment material can extend to the shaft region located in the fluid circulation or to the gravel filling.

It has been shown that in the liquid circulating system the regions with higher flow density can occur and can be formed. This condition can be advantageously improved or forced when the transverse wall provided with the opening for the throughgoing passage is vertically adjustable and is provided with a screening casing which is located before a permeable shaft wall portion. Thereby the shaft inlet cross-section for the liquid is changed and the flow speed can be influenced. Due to the arrangement of the liquid inlet region in a predetermined ground layer, especially strong through rinsing of the ground layer can be produced. This through rinsing can be increased when a partial flow return conduit or return conduits are in the same ground layer and the return flow is performed with overpressure.

In order to provide the subdivision of the shaft into an upper and a lower region required for producing a liquid circulation, a turbulent water flow and/or a water-gas mixture between both regions which are water impermeably separated from one another can be obtained. Such a turbulent water flow can be obtained for example by means of a fitting screw or a whirl flow compressor.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 5 is a fourth embodiment of an arrangement for influencing liquid in ground in accordance with the present invention.

FIG. 5*a* is a further modification of the arrangement of FIG. 5.

DESCRIPTION OF THE PREFERRED EMBODIMENTS

Figure 1:
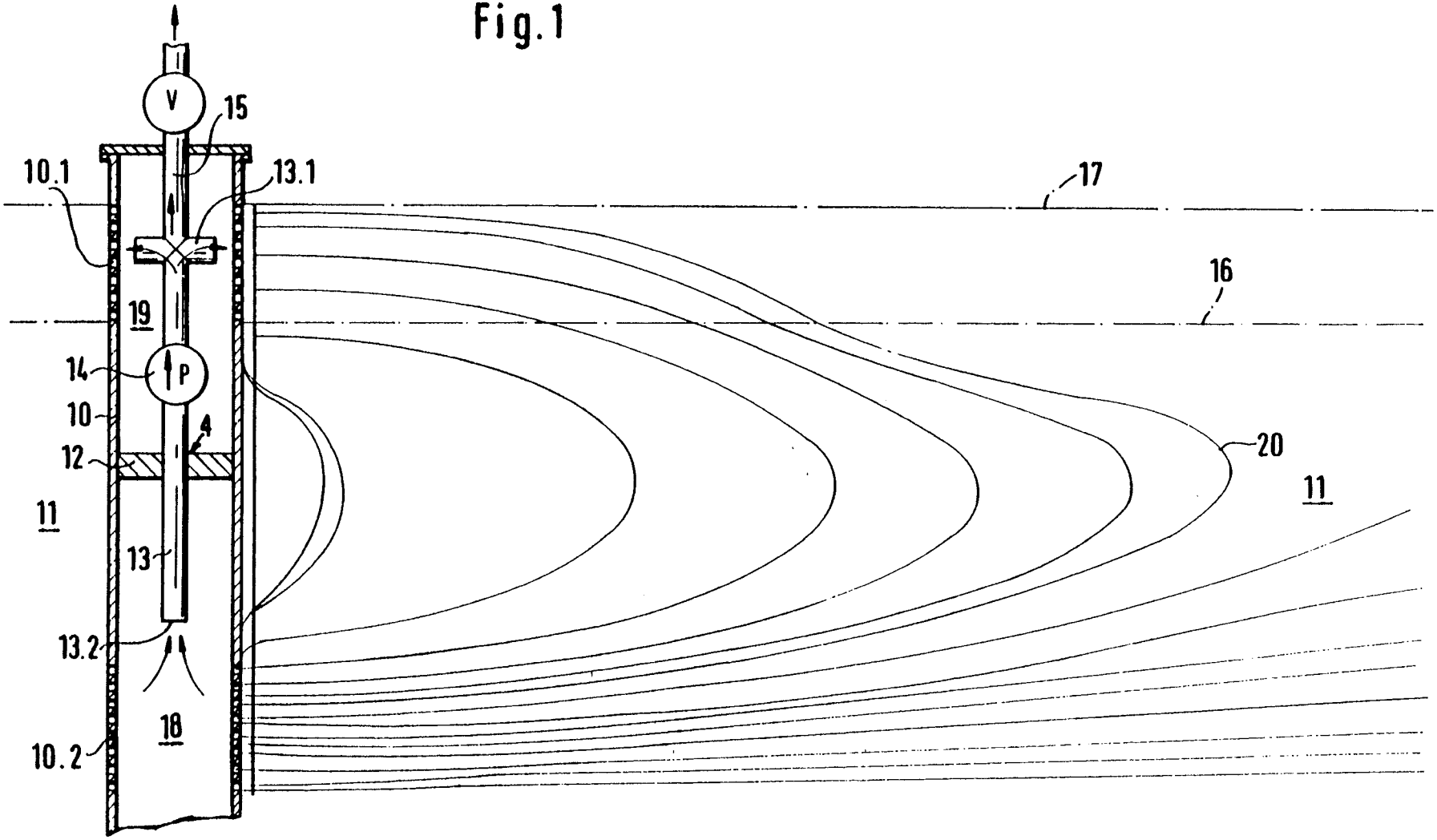
FIG. 1 is a flow diagram of a circulation produced by an arrangement in accordance with the present invention.

FIG. 1 shows a well shaft 10 which is arranged in a shaft which is located in a ground region 11 and has an upper permeable portion 10.1 and a lower permeable wall portion 10.2 spaced from the upper portion. A transverse wall 12 is sealingly inserted between both permeable wall portions 10.1 and 10.2 in the valve pipe. It has a throughgoing opening 4 for a tubular throughgoing passage 13. In the throughgoing passage 13 a preferably electrically operated pump 14 is arranged. The throughgoing passage 13 has lateral outflow openings 13.1 at the height of the upper permeable wall portion 10.1, and an inflow opening 13.2 provided at its lower end. The throughgoing passage 13 extends upwardly to a partial flow supply conduit 15 which leads outwardly to a not shown treatment device.

In an immovable condition of the arrangement the ground water assumes a level 16 underneath a ground surface 17. During the operation of the pump 14 the ground water located in the region 18 of the well shaft 10 is aspirated into the throughgoing passage 13 and supplied in its greater part through the outflow opening 13.1 into the upper region 19 of the well shaft. A smaller part of the supplied liquid can be withdrawn when needed through the partial stream supply conduit 15. The upwardly transported liquid in the region 19 of the well shaft 10 flows through the permeable wall portion 10.1 outwardly into the ground. There it produces ground water flow between the upper and lower permeable wall portion 10.2, its flow diagram is shown in FIG. 1 with potential lines 20.

In contrast to a well shaft from which ground water is only aspirated, no undesirable ground water lowering occurs but instead a ground water raise. The water circulation through the ground region 11 from the upper permeable wall portion 10.1 to the lower permeable wall portion 20.1 of the well shaft 10 extends through an unexpectedly great peripheral region of the shaft. In the region of the lower permeable wall portion 10.2 a very active flow profile is obtained, and further ground water which until now has not been in circulation is pulled into this strong flow. The arrangements for influencing liquid located in the ground under the formation of a liquid circulation can be adjusted in different manner to the local conditions and special applications.

Figure 2:
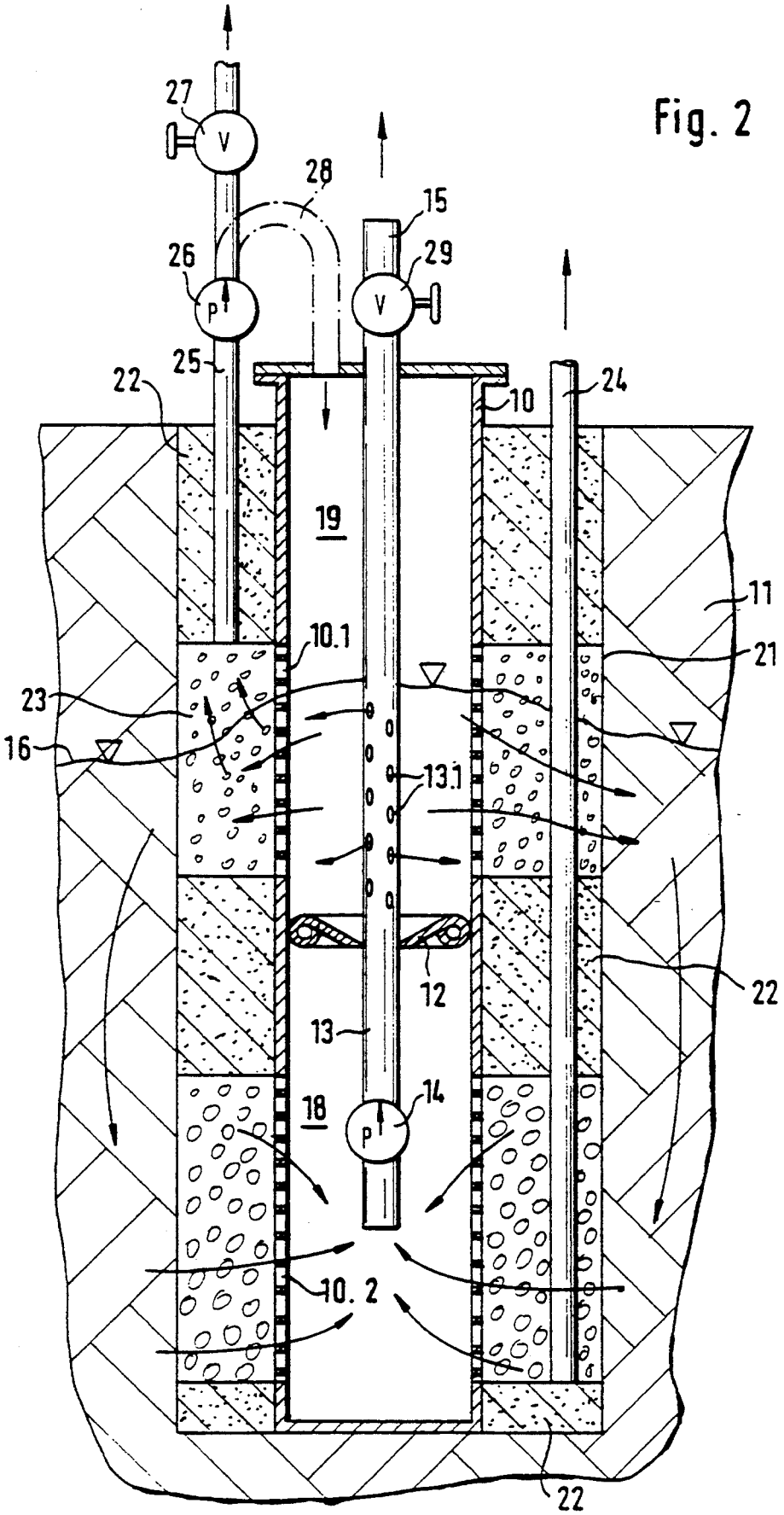
FIG. 2 is a view showing a first embodiment of an arrangement for influencing liquid in ground in accordance with the present invention.

FIG. 2 shows an arrangement in which the well shaft 10 with its both permeable wall portions 10.1 and 10.2 is arranged in a shaft 21 with a substantially greater diameter. The intermediate space between the wall of the shaft 21 and the well pipe 10 is filled around the impermeable wall portion with a sealing mass 22 identified with an intersecting hatching, and is also filled around the permeable wall portions 10.1 and 10.2 with a permeable gravel filling 23. Since air and other free gas mixtures located in the ground make difficult the circulation produced by the pump 14 in the throughgoing passage 13, a ventilation of the ground in the region of the gravel filling 23 is provided.

For this purpose a ventilating pipe 24 is arranged at the right side of the valve shaft 10. The ventilation pipe 24 extends parallel to the well shaft 10 through its whole length and has a sieve wall at the height of the gravel filling 23. The ventilation can be performed forcedly, as shown at the left side of in FIG. 2. There ventilating pipe 25 extends to the upper gravel filling 23 before the wall portion 10.1, in which a ventilator 26 produces a negative pressure and gases can be withdrawn outwardly through a valve member 27 of the aspiration pipe. A return conduit 28 is identified with a broken line and leads to the shaft region 19. A gas circulation stream can be formed through the return conduit 28 by means of the ventilator 26 to flow through the region 19 of the well shaft 10 and the liquid free part of the permeable wall portion 10.1. In this case the gas circulating stream serves not only for ground ventilation, but also for preventing a hardening of the liquid free parts of the liquid permeable wall portion 10.1. Nitrogen can be used here as gaseous medium.

A great number of openings formed in the tubular throughgoing passage formed the outflow opening 13.1 in the throughflow passage 13. The throughflow passage 13 is extended through a throttle point 29 to the partial flow supply conduit 15.

Figure 3:
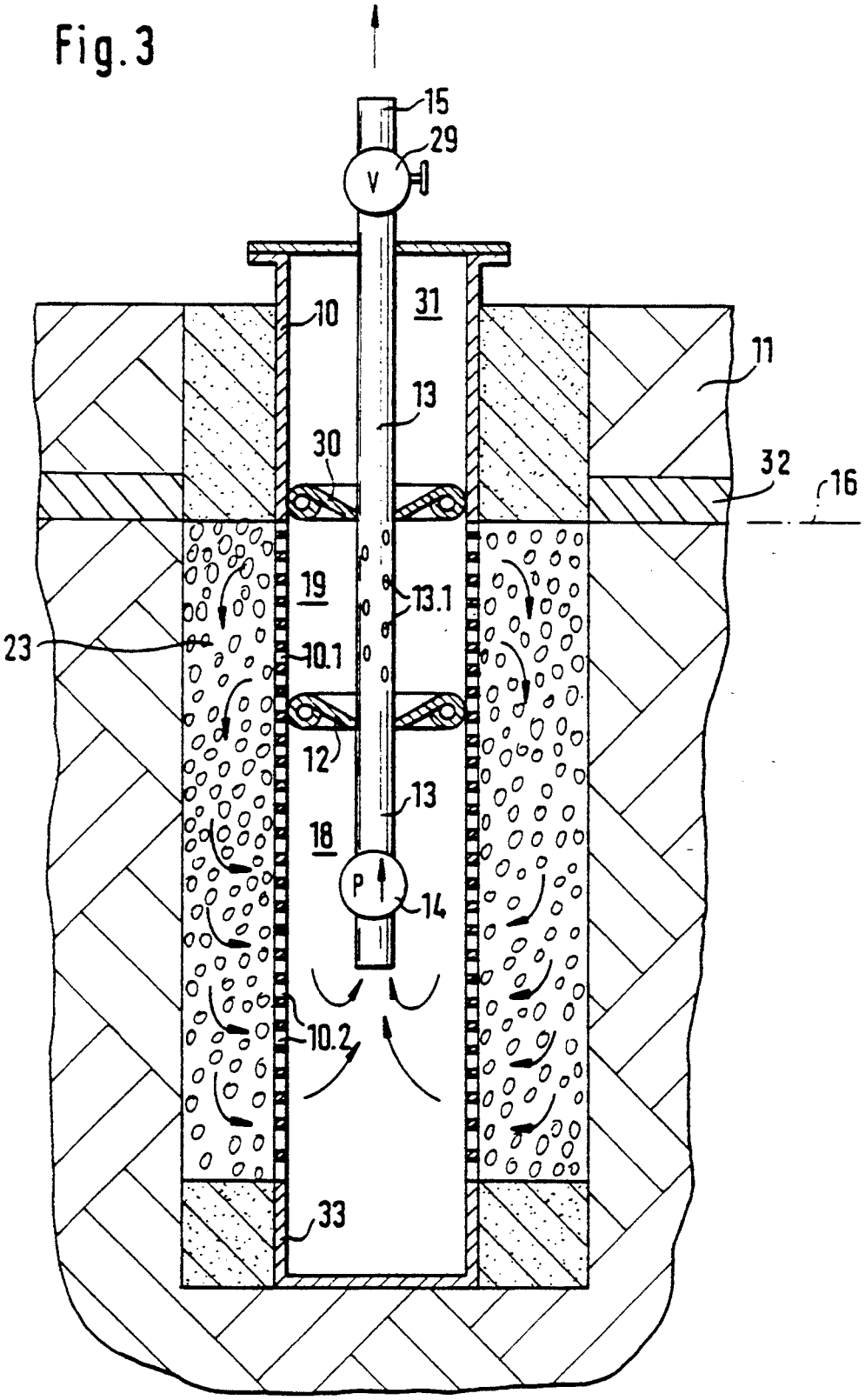
FIG. 3 is a view showing a second embodiment of the arrangement of influencing liquid in ground.

The arrangement in accordance with the embodiment of FIG. 3 differs from the arrangement of FIG. 2 by a second transverse wall 30 located in the interior of the well shaft 10. Also a sealing mass 22 in the central well pipe region is dispensed with for facilitating a filter gravel rinsing for cleaning purposes. The transverse wall 30 through which the tubular throughgoing passage 15 extends, closes the region 19 of the valve shaft 10 which is limited by the permeable upper wall portion 10', with respect to a fluid free upper pipe region 31. A liquid tight horizontal wall 32 is arranged around the well shaft at the height of the normal ground water level 16 in the ground 11. It prevents a raise of the fluid forced in the circulating movement, above the normal fluid level 16. It also provides a horizontal outflow of the liquid along a greater region than the flow diagram shows in FIG. 1. In this embodiment of the arrangement a very strong pump 14 is utilized, which can form a very high liquid overpressure in the region 19 of the valve shaft 10. The shown thick arrow indicates the rinsing water path in the filter gravel layer during high pressure cleaning process. The lower end of the valve pipe 10 is formed by a deposit bath 33.

Figure 4:
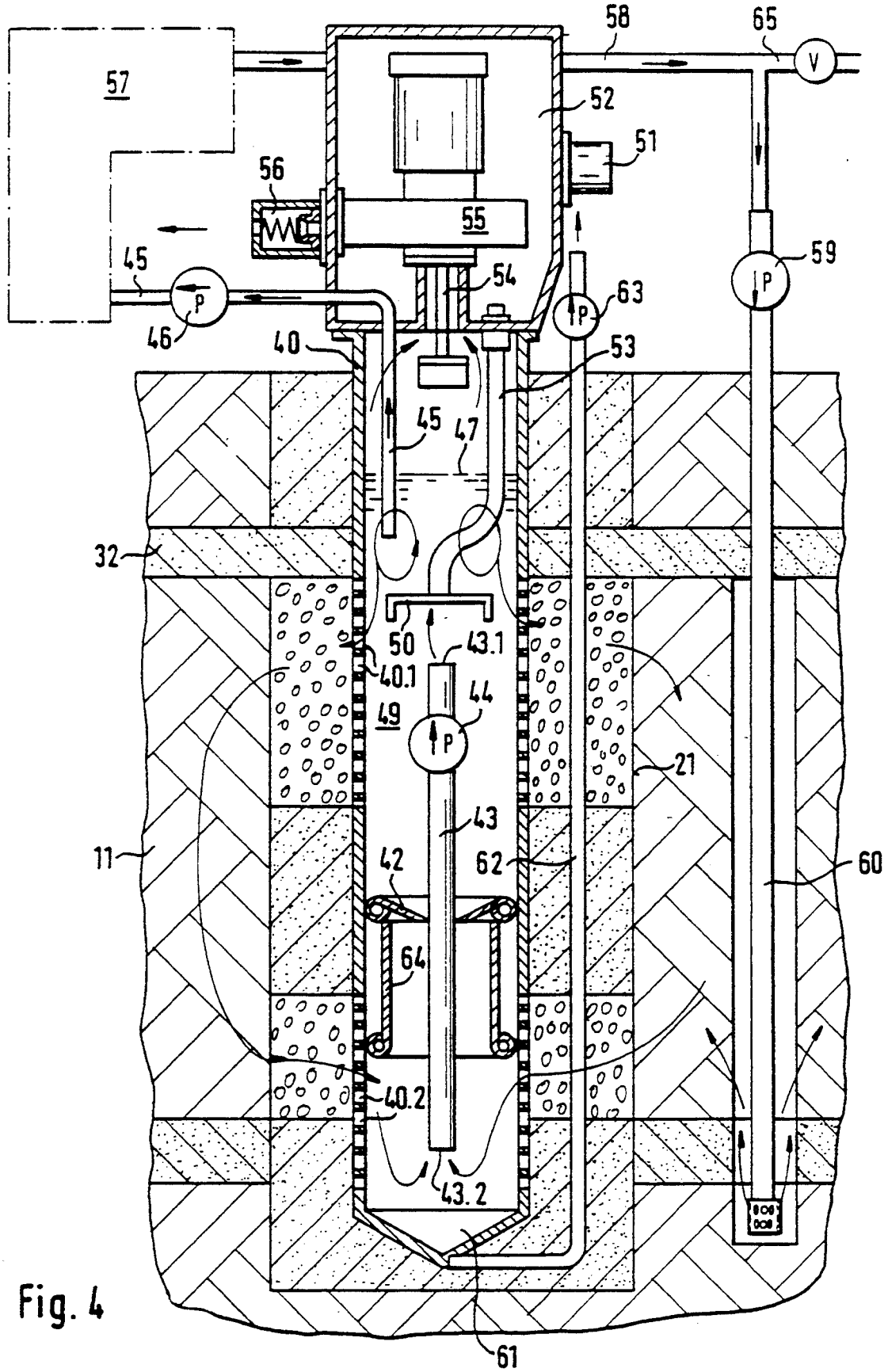
FIG. 4 is a view showing a third embodiment of the arrangement for influencing liquid in ground.

FIG. 4 shows an embodiment in which an arrangement for forming a fluid circulation in the ground region 11 for withdrawing a liquid partial flow is combined with an arrangement for a negative pressure evaporation of light soluble impurities from the ground water. Moreover, this arrangement is suitable for use in areas with purged ground water or for operation with negative pressure differences between the well shaft and the ventilation region located outside the well pipe. A well shaft 40 located in the shaft 21 is provided under the normal available liquid level with an upper permeable wall region 40.1 and a lower permeable wall region 40.2. A liquid circulation is produced by a pump 44 which is arranged in a throughgoing passage 43 extending through a transverse wall 42. The throughgoing passage 43 with its lower inlet opening 43.2 ends with its upper outflow outlet opening 43.1 in the well pipe region 49. A special partial flow supplying conduit 45 leads from the well pipe region 49, and a feed pump 46 is arranged in it.

A nozzle body 50 is located in the well pipe region 49 for performing a negative pressure evaporation process. It is located under the liquid level 47 formed in the shaft and operates in a known manner as disclosed for example in the German Gebrauchsmuster 88 08 089 which describes its operation. A gas supply to the nozzle body 50 is performed from a connection 51 through a pressure receiving chamber 52 and through a gas conduit 53. The gas withdrawal from the well shaft is performed through an aspiration passage 54 of a ventilator 55 and through a pressure limiting valve 56.

For providing a wider horizontal discharge of the liquid from the wall portion 40.1 of the well pipe 40, a water impermeable wall 32 is located in the ground region 11 as shown in the arrangement of FIG. 3. The withdrawn partial liquid stream is supplied through the partial stream supplying conduit 45 to a treatment device 57 shown in a broken line and from there is supplied to a return conduit 59 which leads to a pump 59. The pump supplies the partial flow liquid to a pressure probe 60 arranged in the ground region, or in other words is supplied back under pressure into the circulating region of the fluid in the ground region 11. The return flow is performed substantially at the height of the lower permeable wall portion 40.2 of the well shaft, at which height in accordance with the flow diagram of FIG. 1 an especially intensive horizontal return flow to the well pipe is available. A water impermeable ground region located under it is favorable for the orientation of the return flow stream. Due to this intensive flow movement which is increased by a pressure lance 60, even tough impurities such as, for example, impurities like crude oil can be whirled free in this ground region and discharged to the well shaft 40, where they can be collected in a deposit cup 61 formed at the bottom of the well pipe 40. From there they can be withdrawn through a discharge conduit 62 by a pump 63.

The flow profile of the produce liquid circulation can be influenced by a change of the inlet cross-section of the lower wall portion 40.2, for example it can be compressed. For this purpose the transverse wall 42 can be vertically adjustable in a not shown manner and provided with a screening casing 64. Depending on the height of the transverse wall 42 the screening casing can cover a greater or smaller region of the permeable wall portion 40.2.

In the arrangement of FIG. 4 traditional liquid can be supplied from a supply conduit 65 into the ground region in the circulation through a pressure probe 60. A treatment liquid or a storage liquid can be used here depending on the purpose for which the arrangement is utilized for forming a liquid circulation and a partial stream withdrawal.

FIG. 5 shows a well pipe 10 with a water permeable wall subdivided into regions 18 and 19 similarly to FIGS. 1–4. In contrast to the arrangement of FIGS. 1–4, no transverse wall is provided for separation of the regions. Instead a region 71 is a turbulent water flow 70 produced by a whirl flow compressor 72, which is simultaneously responsible for supplying water from the lower shaft region 18 through the throughgoing passage 13. Instead of the whirl flow compressor 72, also a simple transporting screw **72*a* can be used as shown in FIG. 5*a*, or air can be blown through a pipe into the region 71 for providing a water tight separation of both regions 18 and 19. With a relatively large pump housing, an intensive reduction of the throughflow cross-section of the well shaft 10** can be obtained such that with a corresponding supplied quantity a water dam of the pump can be produced which acts as a separating wall.

It will be understood that each of the elements described above, or two or more together, may also find a useful application in other types of methods and constructions differing from the types described above.

While the invention has been illustrated and described as embodied in an arrangement for and a method of influencing water in ground, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A method of circulating liquid in the ground without causing a drop in the level of such liquid in the ground, comprising:

forming a shaft in the ground which extends down to a desired region occupied by said liquid, said shaft having liquid permeable portions at a lower and an upper region thereof;

placing a conduit within said shaft which extends from said lower region of said shaft, upward to a location outside of said shaft; said conduit also having an outlet in said upper region of said shaft;

pumping liquid up through said conduit from said shaft lower region, and pumping part of the liquid out of said outlet into said shaft upper region, and pumping part of said liquid to said location outside of said shaft.

2. A method as defined in claim 1; and further comprising the step of transporting the fluid which is removed from the shaft to an auxiliary device.

3. A method as defined in claim 2, wherein said auxiliary device is a treatment device.

4. A method as defined in claim 2, wherein said auxiliary device is a water utilization device.

5. A method as defined in claim 1; and further comprising returning the removed fluid to at least one location which is remote from the shaft but located in a fluid circulating region at a predetermined height of the liquid in the ground.

6. A method as defined in claim 5, wherein said returning of the removed fluid includes returning under pressure.

7. An arrangement for influencing flow of liquid in ground, comprising a shaft arranged in the ground which extends down to a desired region occupied by said liquid, said shaft having liquid permeable portions at a lower and an upper region thereof;

a transverse wall in said shaft between said lower and upper regions, with a throughgoing passage;

a conduit in said wall throughgoing passage;

said conduit extending from said lower region of said shaft, through said wall throughgoing passage, and upward to a location outside of said shaft; said conduit also having an outlet in said upper region of said shaft;

a pump arranged in said conduit for pumping liquid from said lower region of said shaft through said conduit;

means to allow part of the pumped liquid to exit through said outlet into said shaft upper region, and to allow part of the pumped liquid to be delivered to a treatment device at said location outside of said shaft.

8. An arrangement as defined in claim 7, and further comprising a partially permeable return flow member arranged near the shaft and providing a return flow of said liquid removed from the shaft into the surrounding ground.

9. An arrangement as defined in claim 8, wherein said return flow member is formed as a partially permeable return flow pipe.

10. An arrangement as defined in claim 8, wherein said return flow member is formed as a partially permeable return flow shaft.

11. An arrangement as defined in claim 7, wherein said outlet of said conduit comprises a plurality of openings open toward said upper region permeable portion; a valve in said conduit above said openings.

12. An arrangement as defined in claim 11; and further comprising a further transverse wall, said transverse walls limiting therebetween a further shaft region in which said throughgoing passage opens.

13. An arrangement as defined in claim 7, wherein said transverse wall is vertically adjustable and is provided with a screening casing placeable before one of said permeable wall portions.

14. An arrangement as defined in claim 7; and further comprising a water impermeable horizontal wall located in the ground substantially at a height of a liquid level in the ground.

15. An arrangement as defined in claim 7, wherein said shaft is limited by a pipe provided with impermeable and permeable wall portions and transverse walls so that a space between said pipe and said shaft wall is partially filled with impermeable blocking layers and partially filled with a permeable gravel filling, at least said gravel filling being outwardly aerated through an upper one of said blocking layers before said permeable wall portion of said pipe provided for a liquid discharge.

16. An arrangement as defined in claim 15, wherein said permeable gravel filling is under a negative pressure for forced ventilation.

17. An arrangement as defined in claim 15; and further comprising dosing means extending to said gravel filling.

18. An arrangement as defined in claim 7; and further comprising a settling cup for heavy liquid particles provided at an end of said shaft; and an aspiration conduit connected with said settling cup.

19. An arrangement as defined in claim 7, wherein a shaft region above a liquid level is under negative pressure; and further comprising a nozzle body provided for driving out volatile impurities from the liquid and distributing a supplied gas in the liquid.

20. An arrangement as defined in claim 7; and further comprising dosing means extending to a shaft region located in a fluid circulation.

21. An arrangement as defined in claim 7; and further comprising filter walls arranged before said permeable wall portions of said shaft.

22. An arrangement for influencing flow of liquid in ground, comprising a shaft arranged in the ground which extends down to a desired region occupied by said liquid, said shaft having liquid permeable portions at a lower and an upper region thereof;

a transverse wall in said shaft between said lower and upper regions, with a throughgoing passage;

a conduit in said wall throughgoing passage;

said conduit extending from said lower region of said shaft, through said wall passage, and upward to a location outside of said shaft; said conduit also having an outlet in said upper region of said shaft;

a pump arranged in said conduit for pumping liquid from said lower region of said shaft through said conduit;

means to allow part of the pumped liquid to exit through said outlet into said shaft upper region, and to allow part of the pumped liquid to be delivered to a treatment device at said location outside of said shaft;

means for producing a turbulent water flow impermeably separating said shaft regions from one another.

23. An arrangement as defined in claim 22, wherein said means for producing turbulent water flow between said shaft regions includes a transporting screw.

24. An arrangement as defined in claim 22, wherein said means for producing turbulent water flow between said shaft regions includes a whirl flow compressor.

25. An arrangement for influencing flow of liquid in ground, comprising a shaft arranged in the ground which extends down to a desired region occupied by said liquid, said shaft having liquid permeable portions at a lower and an upper region thereof;

a transverse wall in said shaft between said lower and upper regions, with a throughgoing passage;

a conduit in said wall passage;

said conduit extending from said lower region of said shaft, through said wall passage, and upward to a location outside of said shaft; said conduit also having an outlet in said upper region of said shaft;

a pump arranged in said conduit for pumping liquid from said lower region of said shaft through said conduit;

means to allow part of the pumped liquid to exit through said outlet into said shaft upper region, and to allow part of the pumped liquid to be delivered to a treatment device at said location outside of said shaft;

means for producing a water-gas mixture impermeably separating said shaft regions from one another.

* * * * *